US006591441B2

(12) United States Patent
Stegens et al.

(10) Patent No.: US 6,591,441 B2
(45) Date of Patent: Jul. 15, 2003

(54) BRUSHROLL HAVING IMPROVED CLEANING CAPABILITY

(75) Inventors: Alfred H. Stegens, Olmsted Township, OH (US); Eric A. Stegens, Olmsted Falls, OH (US)

(73) Assignee: The Scott Fetzer Company, Westlake, OH (US)

( * ) Notice: Subject to any disclaimer, the term of this patent is extended or adjusted under 35 U.S.C. 154(b) by 0 days.

(21) Appl. No.: 10/283,592

(22) Filed: Oct. 30, 2002

(65) Prior Publication Data

US 2003/0066150 A1 Apr. 10, 2003

Related U.S. Application Data

(63) Continuation-in-part of application No. 09/974,354, filed on Oct. 10, 2001.

(51) Int. Cl.[7] ..... A46B 13/02; A47L 9/06

(52) U.S. Cl. ..... 15/179; 15/182; 15/383

(58) Field of Search ..... 15/179, 181, 182, 15/183, 366, 383, 389, 391, 392

(56) References Cited

U.S. PATENT DOCUMENTS

| | | | | |
|---|---|---|---|---|
| 1,559,830 A | | 11/1925 | Woodall | |
| 1,999,696 A | | 4/1935 | Kitto | |
| 2,372,404 A | | 3/1945 | Taylor | |
| 3,959,847 A | * | 6/1976 | Kaulig et al. | 15/368 |
| 4,221,019 A | * | 9/1980 | Jager et al. | 15/368 |
| 4,307,479 A | * | 12/1981 | Mertes et al. | 15/182 |
| 4,847,944 A | * | 7/1989 | Lackner | 15/392 |
| 4,912,805 A | | 4/1990 | Krasznai et al. | |
| 5,003,663 A | | 4/1991 | Sunagawa et al. | |
| 5,193,243 A | | 3/1993 | Stegens | |
| 5,272,785 A | | 12/1993 | Stegens | |
| 5,373,603 A | * | 12/1994 | Stegens | 15/179 |
| 5,435,038 A | | 7/1995 | Sauers | |
| 5,452,490 A | * | 9/1995 | Brundula et al. | 15/182 |
| 5,465,451 A | * | 11/1995 | Stegens | 15/179 |
| 5,495,634 A | | 3/1996 | Brundula et al. | |
| 5,598,600 A | | 2/1997 | Stegens | |
| 6,003,198 A | * | 12/1999 | Stegens | 15/392 |
| 6,148,475 A | | 11/2000 | Stross | |
| 6,324,714 B1 | * | 12/2001 | Walz et al. | 15/52.1 |

FOREIGN PATENT DOCUMENTS

| | | | |
|---|---|---|---|
| DE | 3039167 | | 5/1982 |
| DE | 30 39 167 | * | 5/1982 |
| EP | 0 484 828 | * | 5/1992 |
| GB | 2628 | | 2/1898 |
| GB | 2086717 | | 5/1982 |
| IT | 671202 | | 10/1964 |

* cited by examiner

*Primary Examiner*—Terrence R. Till
(74) *Attorney, Agent, or Firm*—Watts, Hoffmann, Fisher & Heinke, Co., L. P. A.

(57) ABSTRACT

A vacuum cleaner brushroll including a spindle, bristle tufts carried by the spindle, and sleeves fitted on the ends of the spindle, the bristle tufts including angled end tufts that extend through the sleeve outwardly beyond the ends of the spindle to provide a wide cleaning path and improved edge cleaning capability upon rotation of the brushroll. The sleeve on one end of the brushroll has a pulley.

11 Claims, 4 Drawing Sheets

BRUSHROLL HAVING IMPROVED CLEANING CAPABILITY

This application is a continuation-in-part of Ser. No. 09/974,354, filed on Oct. 10, 2001.

TECHNICAL FIELD

The present invention relates generally to vacuum cleaners, and more specifically to a vacuum cleaner brushroll having improved cleaning capability.

BACKGROUND ART

An example of a vacuum cleaner brushroll and a brushroll mounting assembly is disclosed in U.S. Pat. No. 5,272,785 dated Dec. 18, 1993, the disclosure of which is incorporated herein by reference. The disclosed brushroll mounting assemblies include stub shafts which are fixed in the ends of the brushroll spindle, bearings which have their inner races press fitted on the projecting ends of the stub shafts, and outer end members, e.g. end caps, that receive the outer races of the bearings and serve as a means for mounting the brushroll in the mouth of the vacuum cleaner nozzle.

Certain prior art brushrolls include metal ferrules that embrace the outer ends of the spindle. In a typical construction, the stub shafts extend through center openings of the ferrules into the spindle ends. The metal ferrules can have expanded end openings that receive projecting portions of the end caps in order to guard against threads and dirt entering the bearings.

Conventional brushroll spindles have a pulley belt drive surface near one end and carry rows of bristle tufts which agitate the carpet to loosen the dirt as the brushroll is rotated. Typically, the rows of bristle tufts terminate inwardly of the ends of a brushroll spindle. This is particularly true in the case of brushrolls which have metal ferrules, since they cannot be drilled with conventional wood drills to permit tufting at the ends of the spindle. Thus, a brushroll with metal ferrules at its ends necessarily has poor edge cleaning capability and a cleaning path no longer than the length of the spindle.

SUMMARY OF THE INVENTION

The invention is a new and improved vacuum cleaner brushroll having bristle tufts that are angled outwardly to extend beyond the ends of the brushroll spindle. These angled end tufts widen the normal cleaning path of the brushroll, provide improved edge cleaning capability, and enhance the overall cleaning characteristic of the brushroll.

In the disclosed embodiments, a sleeve is press fitted over each end of the brushroll spindle. The sleeves are made of plastic or other material that can be drilled with a conventional wood drill to form angled tuft holes very near the ends of the spindle. The sleeves prevent cracking or splitting of the spindle ends when they are drilled. The angled end tufts are fixed in the holes and extend outwardly through the sleeves beyond the ends of the spindle.

Moisture changes in wooden spindles can cause shrinking and swelling of the wood. In many conventional constructions, swelling can result in the pins or stub shafts which mount the spindle bearings from loosening the holes of the spindle, thereby causing brushroll rattle and general unsatisfactory operation. The end sleeves of the present invention avoid this difficulty. As the spindle swells against the sleeves, the wood is compressed to maintain a firm grip on the pins or stub shafts that are fitted in the ends of the spindle.

Another feature of the invention is an end sleeve as described above which includes a co-molded drive pulley that takes the place of the enlarged pulley drive surface heretofore formed as an integral part of the wooden spindle near one end. The pulley that is integrally made with the end sleeve can be of any suitable shape that will coact with the vacuum cleaner drive belt. For example, the pulley may have belt engaging grooves or it may be formed to coact with a timer belt drive.

In one disclosed embodiment, the brushroll further includes one piece plastic ferrules at each end of the brushroll. Each ferrule has a peripheral skirt that embraces the end portion of the adjacent sleeve, a hollow pin that is pressed into the end of the spindle and receives the bearing mounting stub shaft, and a web connecting the pin and skirt.

Still other features, advantages and a fuller understanding of the invention will become apparent to those skilled in the art from the following description of the preferred embodiments of the invention and the accompanying drawings.

DESCRIPTION OF PREFERRED EMBODIMENTS

Figure 1:
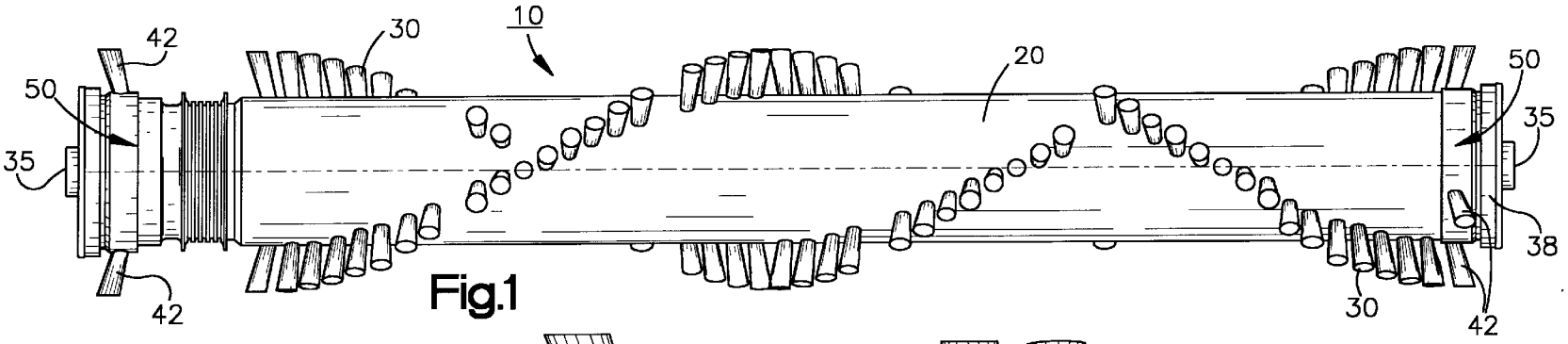
FIG. 1 is a side elevational view of a brushroll according to one embodiment of the invention.

A brushroll 10 according to one embodiment of the present invention is shown in FIG. 1. It includes a wood spindle or dowel 20 rotatably supported at each end by end assemblies 35. Each end assembly can be mounted in the mouth of the vacuum cleaner nozzle (not shown) to rotatably position the brushroll 10. In accordance with conventional practice, the spindle 20 carries rows of bristle tufts 30 which agitate the carpet to loosen dirt as the brushroll is rotated.

Figure 2:
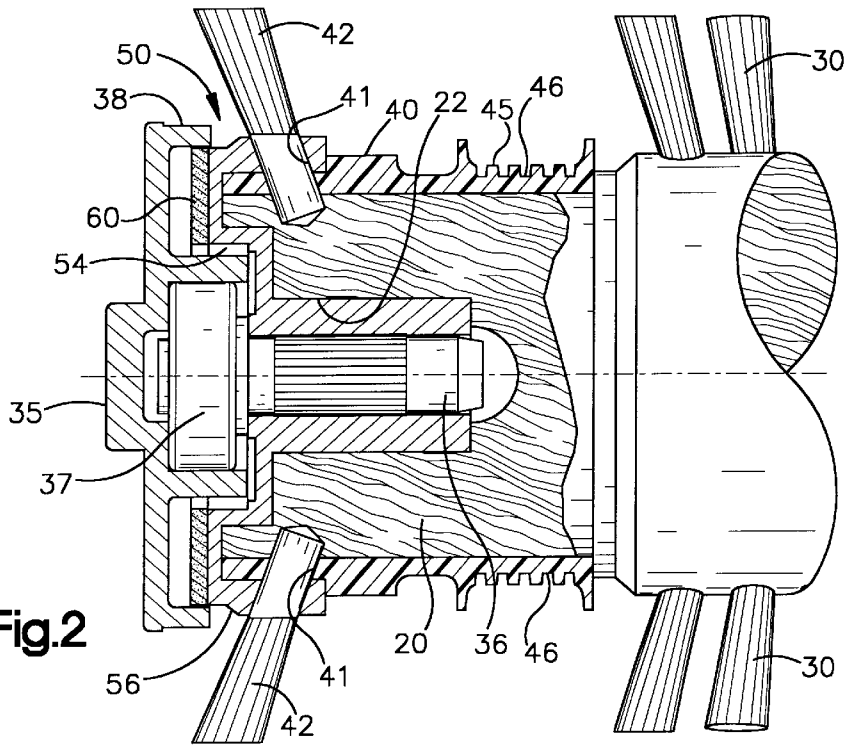
FIG. 2 is an enlarged, fragmentary end view, partially in cross-section, of the brushroll shown in FIG. 1.
Figure 3:
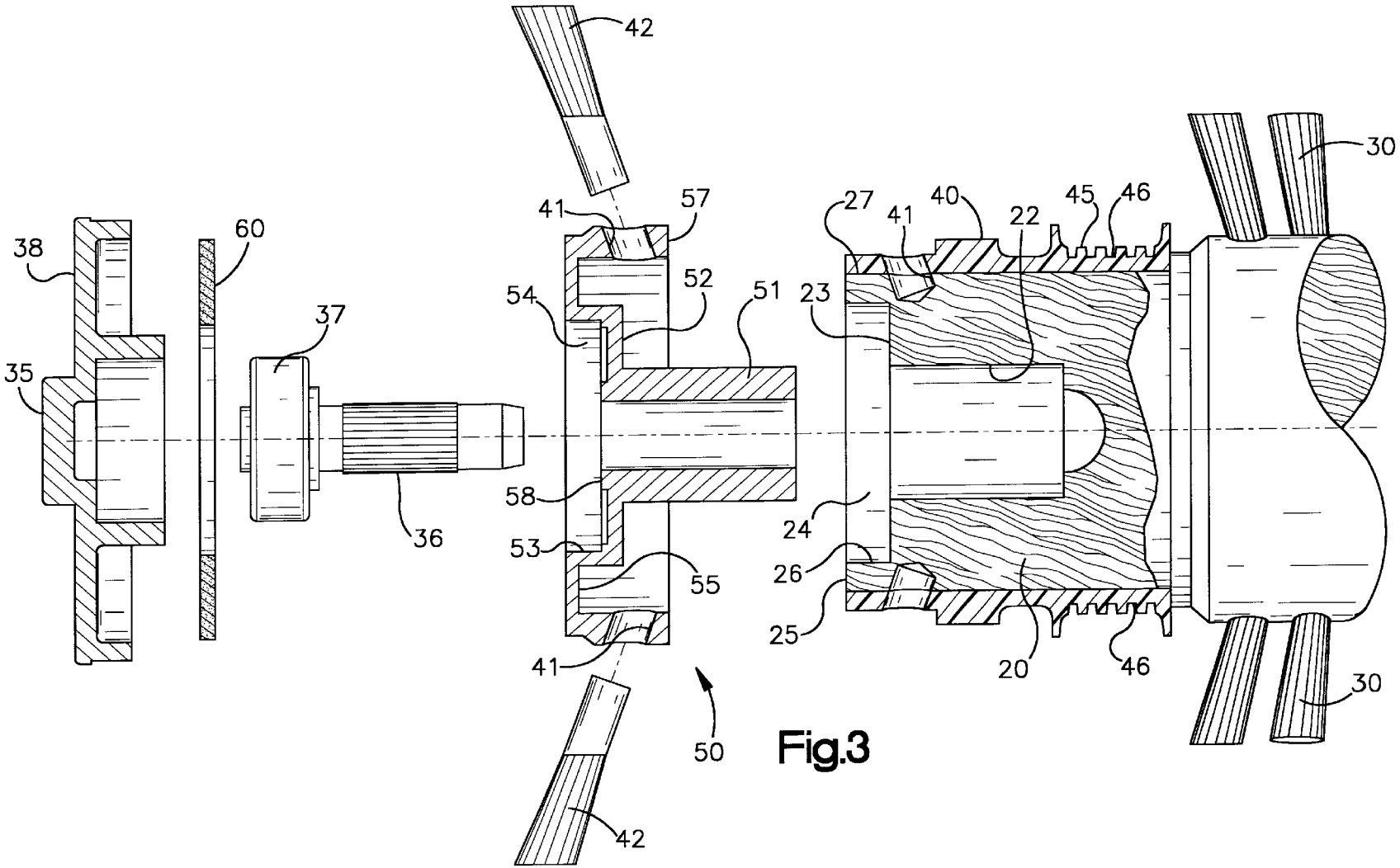
FIG. 3 is a partially exploded end view of the end of the brushroll shown in FIG. 2.

The ends of the spindle or dowel 20 and the end assemblies 35 are similar. Accordingly, only one end of the brushroll 10 is shown and described in detail. As illustrated in FIGS. 2 and 3, an axial hole 22 is drilled in the end of the spindle and opens through the bottom wall 23 of a countersunk mouth 24. An axially extending lip 25 surrounds the mouth 24 and has an inner surface 26 and an outer surface 27.

As more fully disclosed in the above referenced U.S. Pat. No. 5,272,785, each end assembly 35 includes a stub shaft 36, a bearing 37 which has its inner race fitted on a projecting end of the stub shaft 36, and an end member 38 which has a cavity in which the outer race of the bearing 37 is press fitted.

In accordance with the present invention, a sleeve 40 is press fitted over the end of the spindle or dowel 20. The sleeve 40 is made of material, such as plastic, which can be drilled with a conventional wood drill. If desired, the inner surface of the sleeve 40 may be formed with splines (not shown) to aid in holding a sleeve 40 on the end of the spindle 20 and preventing relative rotation between the two members.

The illustrated sleeve 40 includes an integral drive pulley 45 which receives the vacuum cleaner drive belt. The pulley 45 is shown as being formed with grooves 46 that coact with the drive belt (not shown) of the vacuum sweeper.

The embodiment illustrated in FIGS. 1–3 further includes one piece plastic ferrules 50 at the ends of the brushroll 10. As shown, each ferrule 50 comprises a central hollow pin 51, a first radial wall 52 extending outwardly from the end of the pin 51, an axially wall 53 extending from the radial wall 52 to form a mouth 54 at the end of the pin, a second radial wall 55 extending outwardly from the axial wall 53, and a peripheral skirt 56 projecting from the radial wall 55 in a direction opposite to the axial wall 53. The skirt 56 is spaced radially outwardly from the axial wall 53 to form a recess 57 that opens in an axial direction opposite to the ferrule mouth 54. In the illustrated embodiment, a raised seat 58 is formed on the radial wall 52 in the mouth 54 around the inside opening 59 of the pin 51.

When assembling the brushroll 10, the ferrule pin 51 is pressed into the shaft hole 22 until the radial wall 52 bottoms against the bottom wall 23 of the spindle mouth 24. When the ferrule 50 is pressed into the spindle, the spindle lip 26 and the end of the sleeve 40 are captured in the ferrule recess 57 between the skirt 56 and the wall 53.

Holes are drilled in the brushroll spindle 20 for the bristle tufts 30. As shown in FIGS. 2 and 3, angled holes 41 are drilled through the ferrule skirt 36 and the sleeve 40 into the spindle 20 very near its ends. Angled end tufts 42 are fixed in the holes 41. The end tufts 42 are angled from the perpendicular in a direction axially outwardly of the adjacent end of the spindle 20. Since the tufts 42 are located near and extend beyond the ends of the spindle, they provide improved edge cleaning and create a wider cleaning path compared to prior art brush rolls. The sleeves 40 at the ends of the brushroll 10 prevent splitting of the wood spindle or dowel 20 when the holes 41 are drilled.

In a final assembly operation, a felt washer 60 may be adhered to the outer surface of the ferrule wall 55, and the stub shafts 36 are pressed into the pins 51 until the end pieces 38 abut the seats 58 in the mouths of the ferrules. Thus assembled, the members 38 are surrounded by the axial walls 53 of the ferrules in order to guard against thread and dirt from entering the bearings. The sleeves 40 and the ferrule skirts 56 prevent the spindle 20 from expanding because of moisture, and thereby act to maintain a tight fit of the ferrule pins 51 and the stub shafts 36.

Figure 4:
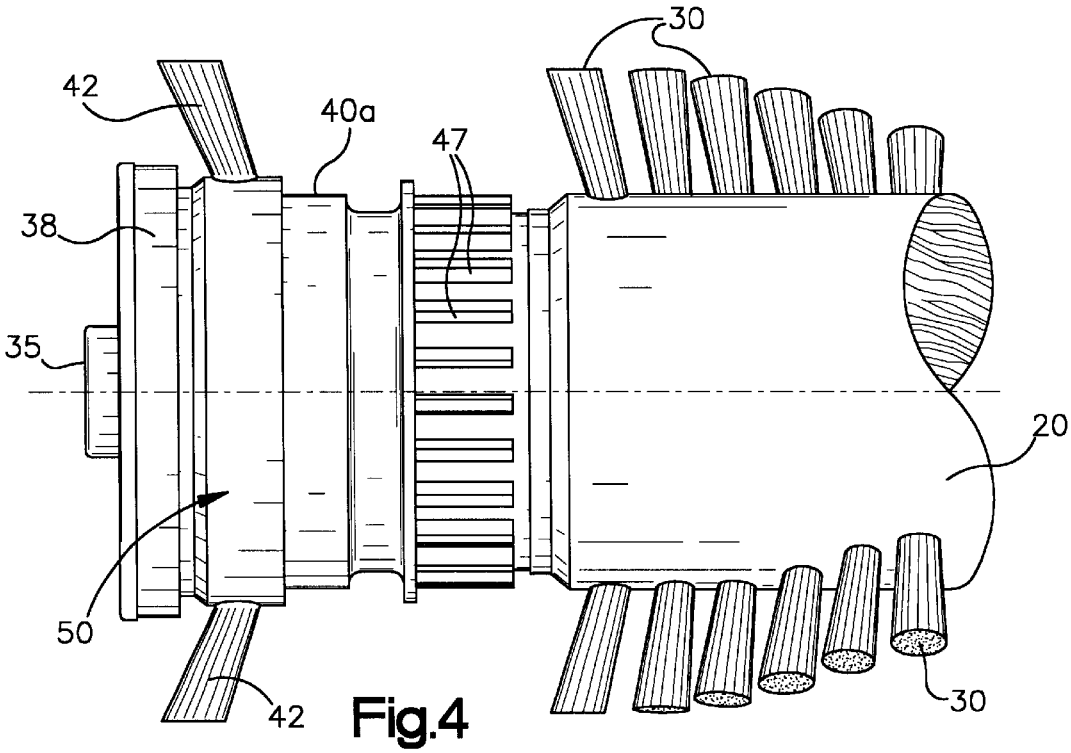
FIG. 4 is an elevational, fragmentary end view of a brushroll according to another embodiment of the invention.
Figure 5:
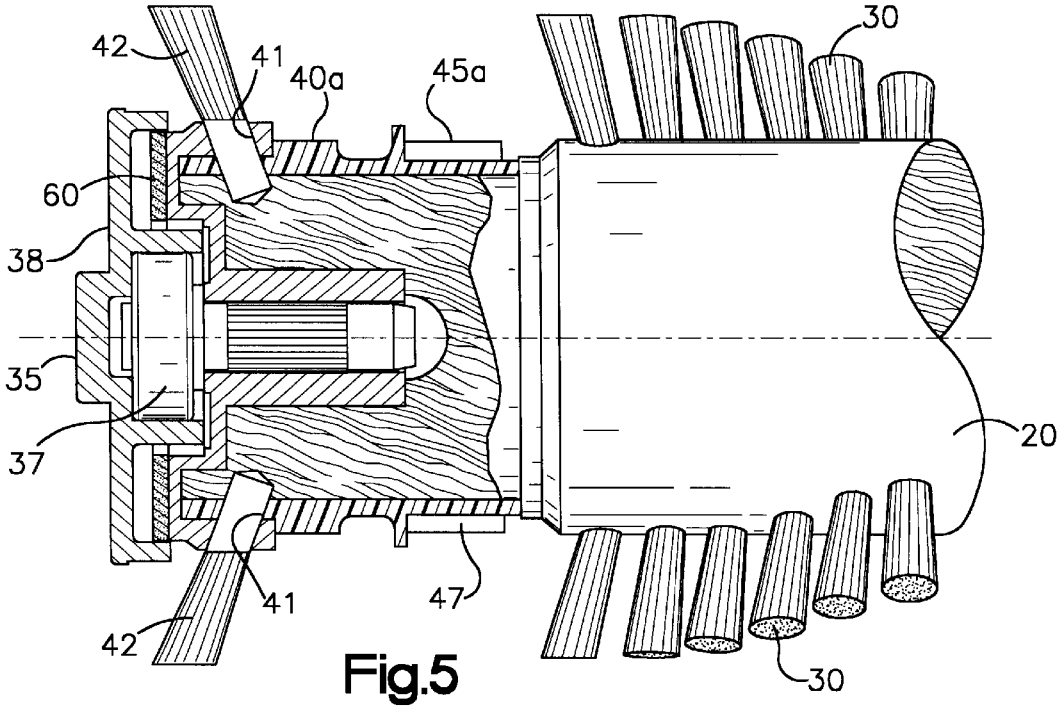
FIG. 5 is a view similar to FIG. 4 partially in cross-section.

FIGS. 4 and 5 show an embodiment of the invention which is similar to the embodiment of FIGS. 1–3 except for the form of the drive pulley. In the embodiment of FIGS. 4 and 5, the sleeve is designated by a reference numeral 40*a* and the pulley by reference numeral 45*a*. The pulley option 45*a* has cogs 47 that coact with a timing belt used in some vacuum cleaners as part of the brushroll drive.

Figure 6:
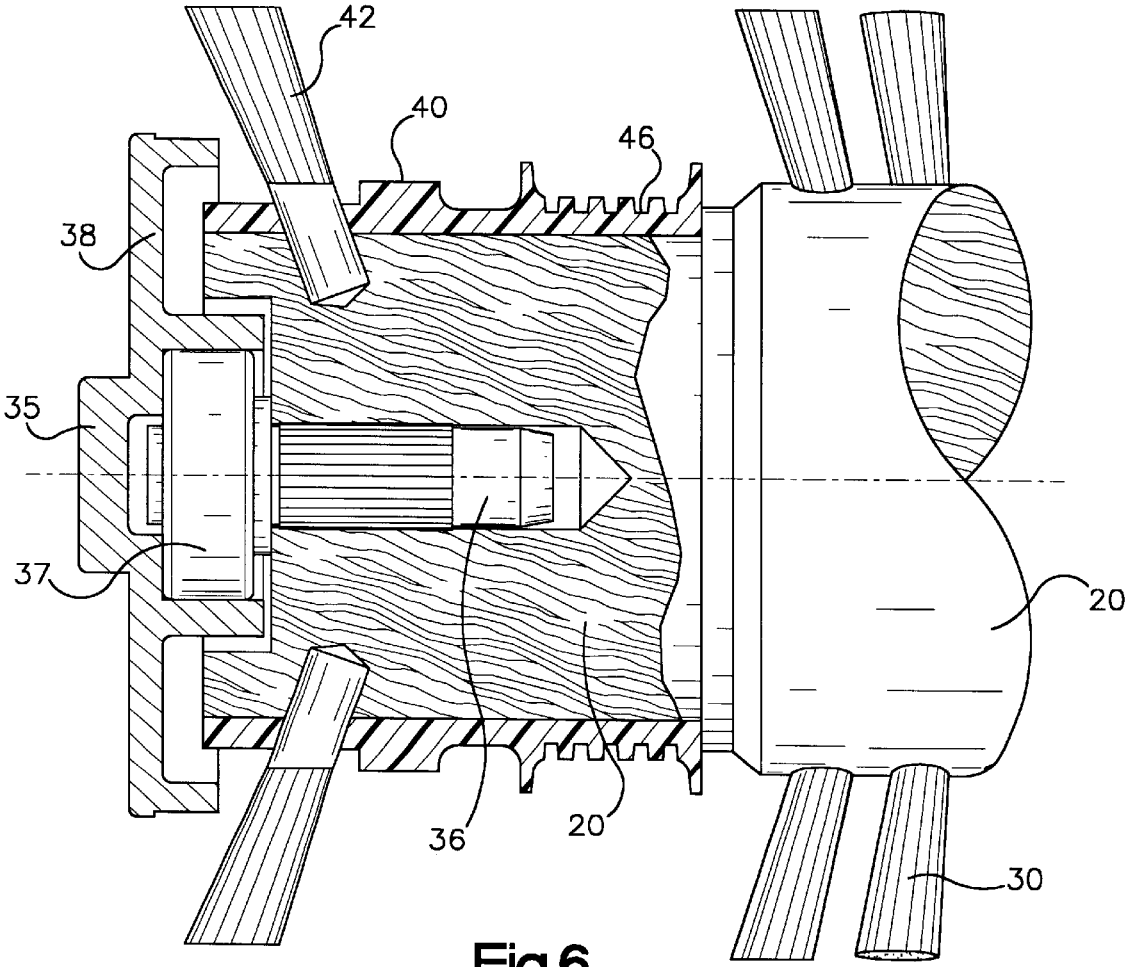
FIG. 6 is a fragmentary end view, partially in cross-section, of a brushroll according to still another embodiment of the invention.

FIG. 6 shows still another embodiment of the invention which is similar to the embodiment of FIGS. 1–3 with the exception that the ferrules 50 are eliminated. The sleeve 40 is press fitted over the end of the spindle 20 as previously described and the angled end tufts 42 extend outwardly of the sleeve 40 beyond the ends of the spindle.

Many variations and modifications of the invention will be apparent to those skilled in the art in light of the above detailed description. Therefore, it is to be understood that, within the scope of the appended claims, the invention can be practiced otherwise than as specifically disclosed.

In the claims:

1. In a vacuum cleaner brushroll including a spindle having a longitudinal axis of rotation and bristle tufts extending outwardly of the spindle, the improvement comprising a sleeve around an end portion of said spindle, a pulley integral with said sleeve, and angled tufts of bristles fixed in said spindle and extending outwardly through said sleeve beyond said end of said spindle to provide a wide cleaning path and an improved edge cleaning capability.

2. The improvement as claimed in claim 1 including a ferrule having a skirt surrounding an end portion of said sleeve, said angled end tufts extending outwardly through said skirt.

3. The improvement as claimed in claim 1 or claim 2 wherein said pulley is a timer belt pulley.

4. The improvement as claimed in claim 1 or claim 2 wherein said pulley has belt engaging grooves.

5. In a vacuum cleaner brushroll including a spindle having a longitudinal axis of rotation and bristle tufts extending outwardly from the spindle, the improvement comprising a member around each end of said spindle, one of said members at one end of said spindle having a pulley belt drive surface, and angled end tufts extending through said members, said end tufts being angled outwardly beyond the ends of said spindle to provide a wide cleaning path and edge cleaning capability upon rotation of said brushroll.

6. The improvement as claimed in claim 5 wherein said members are sleeves.

7. The improvement as claimed in claim 6 including a ferrule having a skirt surrounding an end portion of said sleeve, said angled end tufts extending outwardly through said end portion of said sleeve and said skirt.

8. In a vacuum brushroll including a spindle having a longitudinal axis of rotation and bristle tufts fixed in said spindle and extending outwardly therefrom, the improvement comprising a sleeve around an end portion of said spindle, said sleeve having a pulley belt drive surface, and some of said bristle tufts projecting outwardly through said sleeve.

9. The improvement as claimed in claim 8 including a member having a skirt around said sleeve, and wherein some of said bristle tufts extend outwardly through said skirt.

10. In a vacuum cleaner brushroll including a spindle having a longitudinal axis of rotation and bristle tufts extending outwardly from the spindle, the improvement comprising separate sleeves around each end of said spindle, and said bristle tufts including tufts having their ends fixed in said spindle and projecting outwardly through each sleeve.

11. The improvement as claimed in claim 10, wherein one of said sleeves includes a pulley belt drive surface.

* * * * *